United States Patent [19]

Meins et al.

[11] 4,403,709

[45] Sep. 13, 1983

[54] DRINKING AND POURING AID FOR CONTAINERS OF BEVERAGES AND OTHER LIQUIDS

[75] Inventors: Wolfgang Meins, Aisterredder 44, D-2000 Hamburg 65, Fed. Rep. of Germany; Jürgen Stoldt, Ahrensburg; Peter Rose, Henstedt-Ulzburg, both of Fed. Rep. of Germany

[73] Assignee: Wolfgang Meins, Hamburg, Fed. Rep. of Germany

[21] Appl. No.: 148,727

[22] Filed: May 12, 1980

[30] Foreign Application Priority Data

May 18, 1979 [DE] Fed. Rep. of Germany ..... 2920159

[51] Int. Cl.[3] ..... A47G 19/22

[52] U.S. Cl. ..... 220/90.4; 222/478; 222/527; 222/541; 222/569; 222/570; 222/530; 220/85 SP; 220/229; 220/257

[58] Field of Search ..... 220/85 SP, 90.2, 90.4, 220/90.6, 229, 257, 9.4; 222/478, 481, 530, 527, 541, 566, 567, 569, 570, 546

[56] References Cited

U.S. PATENT DOCUMENTS

| | | | |
|---|---|---|---|
| 2,550,568 | 4/1951 | Kersh | 222/567 UX |
| 2,839,229 | 6/1958 | Scheswohl | 222/567 |
| 3,197,089 | 7/1965 | Michael | 220/90.6 X |
| 3,207,377 | 9/1965 | Lemelson | 222/567 X |
| 3,298,577 | 1/1967 | Chlystum | 222/530 X |
| 3,481,515 | 12/1969 | Booth et al. | 222/541 X |

FOREIGN PATENT DOCUMENTS

| | | | |
|---|---|---|---|
| 1199641 | 12/1959 | France | 222/569 |
| 1229426 | 4/1971 | United Kingdom | 220/90.4 |

*Primary Examiner*—David A. Scherbel
*Attorney, Agent, or Firm*—Becker & Becker, Inc.

[57] ABSTRACT

A drinking and pouring aid for beverage- and other liquid-containing containers or cans provided with a pull or press-in tab in the can cover or lid for creating a can opening. The cover or lid surface is provided with a cover, of plastic synthetic material, which sealingly engages all around the can opening. This cover has a nipple-like mouthpiece in the region of the can opening.

3 Claims, 10 Drawing Figures

FIG.7
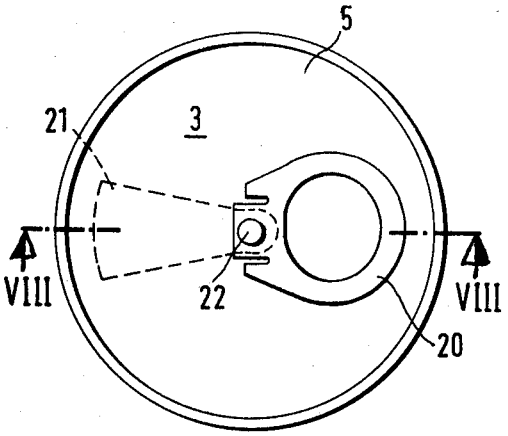
FIG.10
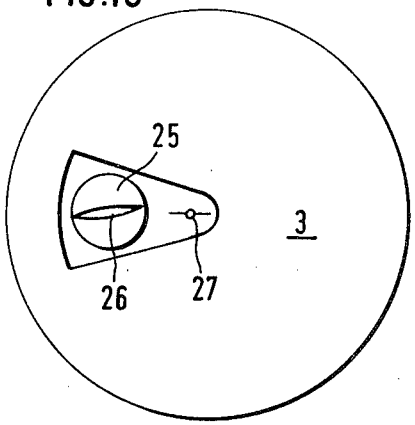
FIG.8
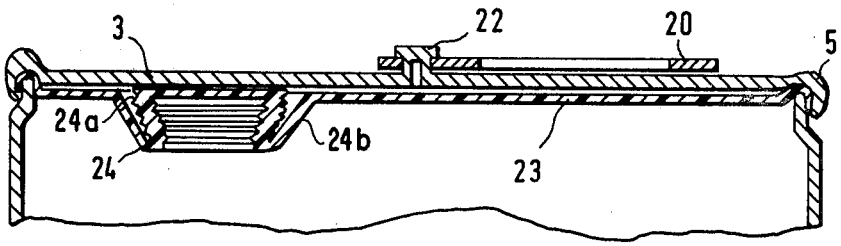
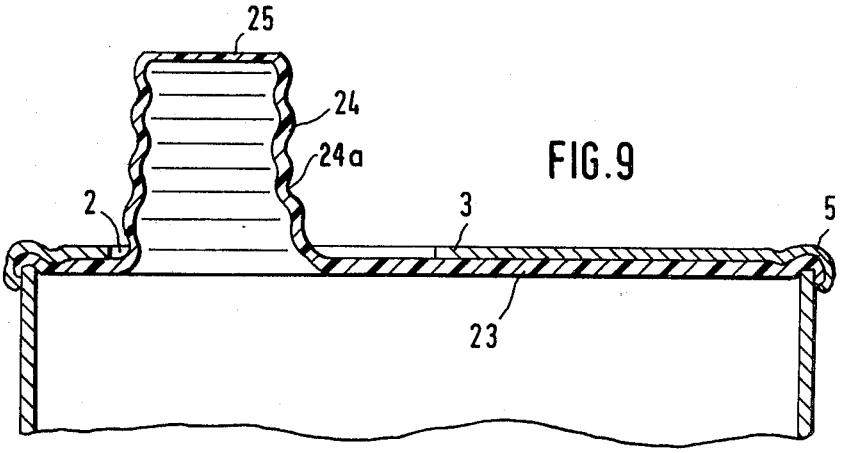
FIG.9

DRINKING AND POURING AID FOR CONTAINERS OF BEVERAGES AND OTHER LIQUIDS

The present invention relates to a drinking and pouring aid for beverage-and other liquid-containing containers or cans having a pull or press-in tab in the can lid or cover for creating a can opening therein.

A consumer drinks from the mentioned beverage container or can directly or with a drinking straw. Alternately, however, the can contents are poured into a cup or glass. Since cups frequently require a price markup, and drinking straws, for instance with beer, are used only unenthusiastically, in most situations drinking occurs directly from the can, even though it is not hygienic and during careless use can easily lead to injuries because of the knife-sharp metallic edges. A further drawback consists in that during opening, the beverage or liquid can spray uncontrolled out of the can or container due to internal pressure.

The object of the present invention is to create a drinking or pouring aid which is or can be connected with the beverage-or other liquid-containing can, and which is so embodied that the aforementioned drawbacks are not encountered.

This object, and other objects and advantages of the present invention, will appear more clearly from the following specification in connection with the accompanying drawings, in which:

FIG. 7 is a plan view similar to that of FIG. 1 of a beverage can or container with a covering arranged in the interior;

FIG. 8 is an enlarged cross sectional view taken along line VIII—VIII in FIG. 7;

FIG. 9 is an illustration similar to that of FIG. 8 in which, in contrast with FIG. 8, the pull tab has been eliminated and the mouthpiece is shown protruding or having emerged through the created can opening; and FIG. 10 shows a plan view of the arrangement of FIG. 9 in the scale of FIG. 7.

Figure 1:
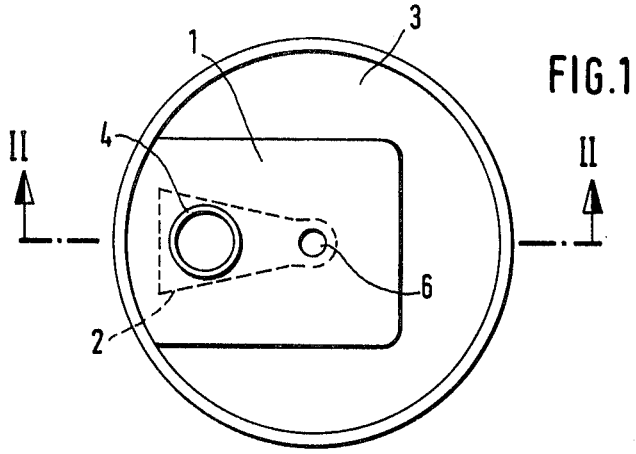
FIG. 1 shows a schematic plan view of a beverage can or container of conventional embodiment provided with the inventive covering.

The drinking and pouring aid of the present invention is characterized primarily in that the lid or top surface of the beverage cans or containers is provided with a cover, of plastic synthetic material, which sealingly engages all around the can opening; this cover has a nipple-like mouthpiece in the region of the can opening. The inventive cover can either be removably arranged on the outside of the can lid, or can be rigidly mounted to the inside of the can lid. In the first situation, the cover includes plasticly deformable projections which can snap or can engage along the edge of the can opening and/or the can lid. These projections hold the covering in sealing engagement all around the can opening. With an arrangement on the inside of the can lid, the mouthpiece of the cover is corrugated tube or accordian-like and is located below the subsequently to be created can opening; furthermore, the mouthpiece is pressed inwardly or is telescoped in th longitudinal direction because of the material elasticity, so that upon removal of the pull or press-in tab, the mouthpiece can spring outwardly.

The inventive device, which is especially simple and economical to produce, is not only hygienic, but also precludes any danger of injury.

Referring now to the drawings in detail, commercially conventional beverage cans or containers are generally embodied as shown in the plan view of FIG. 7. The actual can body is provided with a cover 3 on the upper side thereof. This cover 3 is closed or sealed with respect to the edge of the actual can or container body 10 by means of a rolled-in flange 5. The cover 3 has a pull tab 20, the actuating ring of which is connected with the can cover by a centrally arranged rivet or pin 22. By lifting and removing the pull tab, an essentially trapezoidal opening 21 results in the cover surface 3 when a removable area defined by a frangible seam is removed. All of these features belong to the known state of the art.

Figure 2:
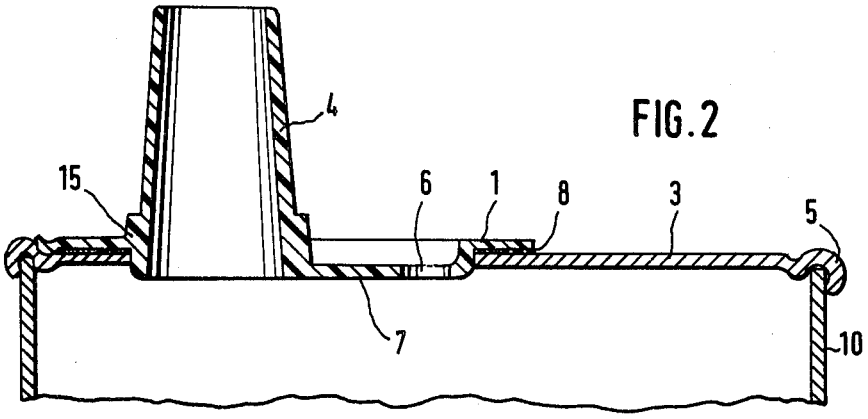
FIG. 2 is an enlarged cross section taken along line II—II in FIG. 1.

According to the embodiment of the present invention as illustrated in FIGS. 1 and 2, a cover 1 is placed upon the cover surface 3. This cover 1 may, for example along the engagement surface thereof, be provided with a bonding adhesive which is protected prior to use by a removable siliconized paper.

The actual cover, with all of the embodiments, is so embodied that is completely covers the can opening 2 created by the pull or press-in tab. The cover 1 has a nipple-like mouthpiece 4 in the region of the can opening 2. The liquid or beverage of the can or container can be supplied for consumption by way of the mouthpiece 4, i.e., and individual can either drink directly from the mouthpiece 4, or can use the mouthpiece as a spout.

With the embodiment according to FIGS. 1 and 2, the cover 1 is secured in the can or container cover by being provided with a projection 7 which corresponds to the cross section of the can opening and can be pressed into the can opening 2 in a positive manner. A bonding or contact adhesive 8 can be used for additional securing purposes as already mentioned. Since the cover 1 with the mouthpiece 4 can be installed only after opening the can, this cover is preferably stackably embodied, i.e., for example as shown in FIG. 2, with a thickening or widened portion 15 which in the stacked condition facilitates removal of individual covers having a mouthpiece.

The cover 1 is provided with an air equalizing opening 6 in the region of the can opening 2. This air or pressure equalizing opening is selectively a small round bore, a small narrow slot, or also an opening which is provided with a relief or check valve which opens toward the can interior. Such a check valve precludes the spraying out of the container liquid, which under certain circumstances may be under pressure. During drinking or pouring of the liquid or beverage, however, such a check valve can open, so that the drinking or pouring-out of the liquid or beverage occurs without undesired spray effects.

Figure 3:
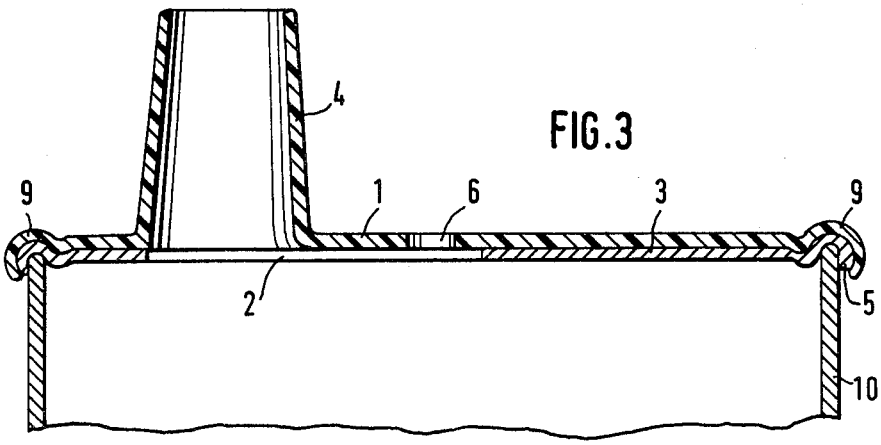
FIG. 3 shows an embodiment similar to that of FIG. 2 with which the covering is secured along the can edge.

With the embodiment according to FIG. 3, the cover 1 extends over the entire can surface. The cover 1 can be snapped or engaged about the entire can periphery over the can rolled-in flange 5 by means of a slight rolled-in flange 9 arranged along the edge of the cover 1, so that also in this situation a sealing closure of the can opening is secured all around the opening of the mouthpiece 4. A venting opening 6 can also be provided.

Figure 5:
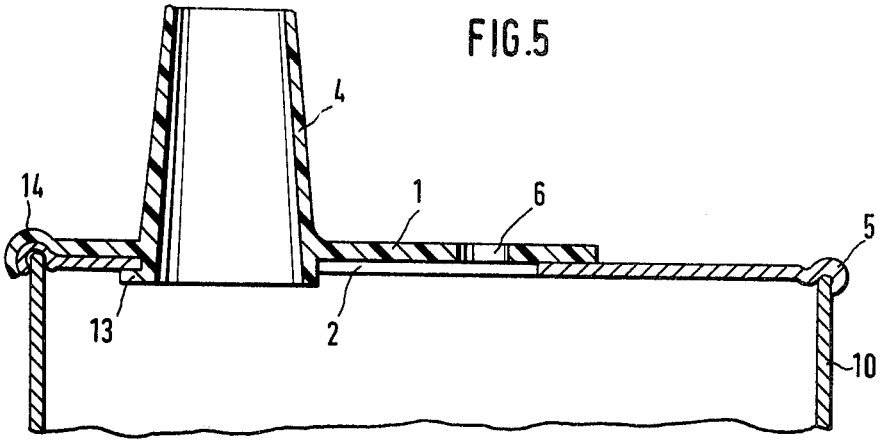
FIG. 5 is an enlarged cross sectional view taken along line V—V of FIG. 4.
Figure 4:
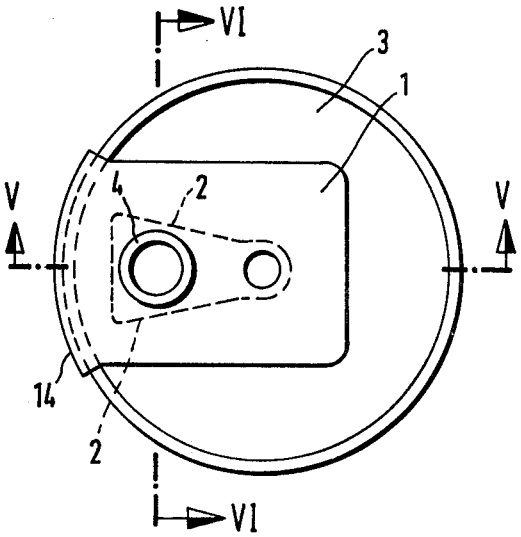
FIG. 4 is an illustration similar to FIG. 1 though representing a modification with which the covering is mounted both along the can opening and also along the can edge.
Figure 6:
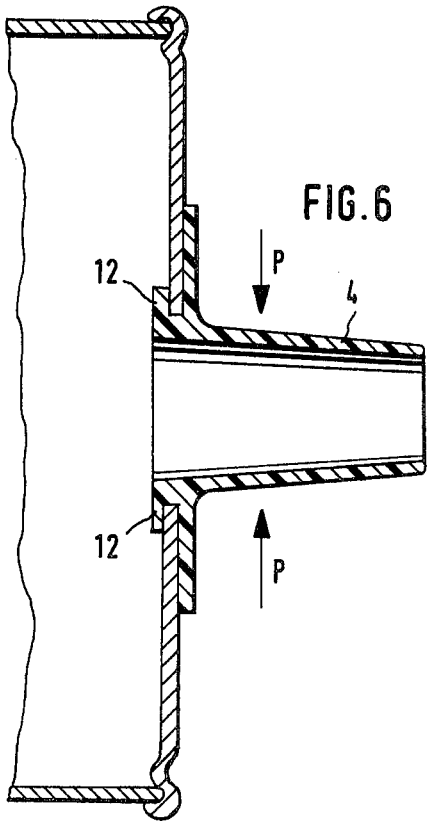
FIG. 6 is an enlarged cross sectional view taken along line VI—VI in FIG. 4.

To further embodiment according to FIGS. 4 through 6 differs from the previously described embodiments in that the cover 1 can be fastened both on the edge of the can opening and also on the flange edge of the can. As shown in the drawing, a slightly rolled-in edge 14 of the cover engages a small part of the can periphery over the flange edge 5 thereof. An additional fastening in the can opening is effected by a projection 13 extending longitudinally of the can opening 2, and two projections 12 extending transverse to the can opening 2. Since the mouthpiece 4, which is made of plastic material, is pressed together in the direction of the arrows P as shown in FIG. 6, the projections 12 and 13 after hooking or engaging the rolled-in edge 14, are introducible into the can opening where they sealingly engage after release of the mouthpiece 4.

FIGS. 7, 8 and 9 show an arrangement with which the cover 23 is arranged inside the can or container, i.e., on the inner side of the cover surface 3 thereof. In this case, the cover 23 extends over the entire inner surface of the can cover. The fastening of the cover 23 forms a web which is effected by being rolled in between the edges of the can 10 and the can cover 3. The mouthpiece or spout 24 is located in the cover 23 in alignment with the can opening 21. The spout includes a collapsible neck portion 24*a*. mouthpiece is capable of being pressed together or compressed to collapse in the axial direction and, because of the elasticity of the material thereof, can be extended to substantially its entire length, assuming no external forces act thereon. The mouth piece or spout 24 also includes a flange portion 24*b* which connects the neck portion 24*a* to the web 23.

When the can illustrated in FIGS. 7 and 8 is opened, that is, a can opening 21 is created by the pull tab 20, the accordian-like folded or telescoped-in mouthpiece 24 springs outwardly through the can opening 21 and projects therefrom, so that it can then be used as a drinking or pouring aid for dispensing the liquid or beverage contained in the can.

The springing-out of the mouthpiece 24 can also be enhanced for example in that the mouthpiece 24, on the outer end thereof, is provided with a face or end wall 25 capable of being torn off or open, with such end wall being capable of being adhered with the pull tab. In this manner, when the pull tab is removed, the mouthpiece 24 is also simultaneously maximally withdrawn or pulled out. The end wall 25, in this case, either remains hanging on the pull tab, so that a drinking opening results, or a slit 26 is formed at least in the end wall 25 as shown in FIG. 10. Such a slit 26 makes possible the drinking in the simplest manner, since by way of pressure with the lips and teeth, the slit 26 can be deformed into a sufficiently large oval. This slit also precludes the undesired spraying-out of the container contents. Also in this case there can be provided an air equalizing opening or vent, illustrated as a slot or slit 27, in the cover 23 in the region of the can opening 21. The slits 26 and 27 of FIG. 10 are preferably produced during the manufacture of the cover. However, as per FIGS. 8 and 9, they may also initially be absent, being produced only just prior to consumption or use of the can contents.

The arrangement of a drinking slit 26 as illustrated in FIG. 10 is naturally also possible with the other previously described embodiments.

The covers provided with a mouthpiece can be produced in an extremely economical manner in a vacuum forming procedure or in an injection molding or die-casting method from synthetic material as a mass produced article of manufacture. It is also possible to use the upper surface of the cover for advertising if the cover is provided on the outer side of the can.

In connection with FIGS. 7 through 10, it should also be noted that with the inner arrangement of the cover 23, there still exists the possibility to secure this cover 23 only partially along the can edge, and in particular, to fasten the cover 23 in such a manner that the trunkline mouthpiece, which in this case need not be accordian-like, swings or pivots out through the created can opening.

Reference has been made throughout the specification to the use of plastic and plastic synthetic material. Such material can, for example, be modified polystyrene, which is flexible yet resistant to impact. Other examples of material which can be used include polypropylene and polyethylene.

In summary, the present invention provides a drinking or pouring aid for liquid-or beverage-containing cans or containers having a pull or press-in tab provided in the can cover for creating a can opening therein. The can cover surface 3 is provided with a cover 1, 23 of plastic synthetic material which sealingly engages all around the can opening 2. This cover has a nipple-like mouthpiece 4, 24 in the region of the can opening 2. The cover 1 may be provided on the outer side of the can lid, and includes plasticly deformable projections 7, 12, 13, 14 which are capable of being snapped onto or of engaging the edge of the can opening 2 and/or the can cover or lid 3; these projections hold the cover 1 in sealing engagement all around the periphery of the can opening 2.

Alternately, the cover 23 may be provided on the inner side of the can lid, where it is fastened or secured at least partially. The mouthpiece or spout 24 has a corrugated tube or accordian-like configuration 24*a* which collapses under the tab 21 which defines a removable area in the covering lid 3. The mouthpiece or spout has a smaller cross section than the can opening 21, and is telescoped or pushed together in the longitudinal direction, counter to the elasticity of the material, when the can or container 10 is closed. The cover 23 may be fastened in the rolled-in flange 5 of the can lid 3. The end face 25 of the nipple-like mouthpiece 24 may be adhered with the pull tab 20, and is capable of being at least partially torn open or torn off.

The cover 1 may be adhered or adhesively secured with the cover surface all around the can opening 2.

The cover 1 provided for the outer side of the lid or cover of the can may be provided with a bonding or contact adhesive along its engagement surface therewith, with the adhesive being protected by removable siliconized paper prior to the uncovering thereof.

At the outer end 25 of the mouthpiece 4, 24, there may be provided a slit 26 which opens by deformation during drinking. The mouthpiece 4 may extend only over a portion of the can opening 2, with a venting opening, 6, 27 being provided in the cover 1, 23 next to the mouthpiece 4. The venting opening 6, 27 may be provided with a check valve which opens in the direction of the interior of the can. The venting opening may be a narrow slit 27 extending generally radially with a hole therein. The cover 1 may be embodied as an advertising surface. The cover 1, 23 may be an injection molded part. The covers 1, respectively provided with mouthpiece 4, may be embodied so as to be capable of being stacked.

The present invention is, of course, in no way restricted to the specific disclosure of the specific action and drawings, but also encompasses any modification within the scope of the appended claims.

What we claim is:

1. A drinking spout arrangement for use with a beverage container having a cover secured to the top of the container wherein the cover has a removable area defined by a frangible seam and connected to a pull tab which removable area creates an opening through the cover when the tab is pulled, the drinking spout arrangement comprising:

a web of elastic material disposed within the container in juxtposition with the cover and being coextensive with the cover to enclose and seal the top of the can, and a resilient spout formed integrally with the web and aligned with the removable area of the cover, the spout being in abutment with the removable area, the spout including a flange portion and a collapsible neck portion with the flange portion connecting the collapsible neck portion to the web; the spout having a cross-section defining an area substantially less than the removable area of the opening whereby when the opening through the cover is created by pulling the tab to discard the removable area, the spout springs beyond the cover and a portion of the web is exposed which is spaced from the spout, the exposed portion of the web having a vent hole therein spaced from the spout and communicating with the interior of the container;

the spout further including a top surface having a slit therein which slit is opened upon squeezing the spout with the mouth to drain the beverage from the container.

2. The drinking spout arrangement of claim 1 wherein the spout is positioned off-center with respect to the axis of the container and wherein the slit extends in a generally radial direction with respect to the container whereby pressure applied to the spout in a direction parallel to the extent of the slit opens the slit.

3. The drinking spout arrangement of claim 1 or 2 wherein the vent includes a small hole which is always open and slits extending from the hole in the general radial direction.

* * * * *